US006588744B2

(12) United States Patent
Ries et al.

(10) Patent No.: US 6,588,744 B2
(45) Date of Patent: Jul. 8, 2003

(54) APPARATUS AND METHOD FOR HANDLING STACKS OF SHEETS

(75) Inventors: Jürgen Ries, Ostfildern (DE); Horst Schempp, Ostfildern (DE); Joachim Schneider, Ostfildern (DE); Andreas Trumpp, Dettingen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/157,414

(22) Filed: May 29, 2002

(65) Prior Publication Data

US 2002/0140161 A1 Oct. 3, 2002

Related U.S. Application Data

(63) Continuation of application No. 09/944,978, filed on Aug. 31, 2001, now abandoned.

(30) Foreign Application Priority Data

Sep. 4, 2000 (DE) ..... 100 43 393

(51) Int. Cl.[7] ..... B65H 31/26

(52) U.S. Cl. ..... 271/220; 271/207; 271/220; 271/224; 399/405

(58) Field of Search ..... 271/207, 220, 271/224; 399/405

(56) References Cited

U.S. PATENT DOCUMENTS

| | | | | |
|---|---|---|---|---|
| 4,718,657 A | | 1/1988 | Otter | |
| 4,750,729 A | * | 6/1988 | Kanoto et al. | 271/162 |
| 4,789,150 A | | 12/1988 | Plain | |
| 5,005,821 A | * | 4/1991 | Burger | 271/198 |
| 5,172,906 A | | 12/1992 | Dole | |
| 5,388,818 A | * | 2/1995 | Anton et al. | 206/455 |
| 5,915,687 A | * | 6/1999 | Rieck | 271/207 |
| 6,227,536 B1 | * | 5/2001 | Bethke | 271/207 |

FOREIGN PATENT DOCUMENTS

| | | | |
|---|---|---|---|
| DE | 85 29 570.1 U1 | | 2/1986 |
| JP | 63-147768 | * | 6/1988 |
| JP | 4-45059 | | 2/1992 |
| JP | 5-254709 | | 10/1993 |

OTHER PUBLICATIONS

Author unknown, Xerography—The invention that no one ever wanted, May 6, 1997, http://members.tripod.com, Whole article.*

Eastman Kodak Company, "key operator instructions for Kodak Ektaprint copier–duplicators" (1977), Cover+pp. 4, 44, 58 & 59.

Eastman Kodak Company, "key operator instructions for Kodak Ektaprint copier–duplicators with positioners and sorters" (1979), Cover+pp. 3, 20 & 21.

Eastman Kodak Company, "The new Kodak Ektaprint 300 duplicator—The right combination" (1986), 3 pages.

Search Report DE Patent–und Markenamt.

* cited by examiner

*Primary Examiner*—Donald P. Walsh
*Assistant Examiner*—Kenneth W Bower
(74) *Attorney, Agent, or Firm*—Kevin L. Leffel

(57) ABSTRACT

A device is provided for holding one or more stacks of sheets, especially stacks of sheets that are stored offset to each other, for example by offset collating, that are output to an output station by a sheet processing device. According to an aspect of the invention, the device consists of a portable container that can be placed at the output station of the sheet processing device, which has a horizontally aligned stacking floor, two upright side walls that are opposite each other and an upright impact wall that is arranged downstream of the sheet output device for the stack of sheets.

18 Claims, 2 Drawing Sheets

APPARATUS AND METHOD FOR HANDLING STACKS OF SHEETS

This application is a continuation of application Ser. No. 09/944,978 filed Aug. 31, 2001, now abandoned, of the same title.

BACKGROUND

The invention relates to apparatus and methods for holding one or more stacks of sheets, especially stacks of sheets that are placed so that they are offset from each other (so-called offset collating), that are output to an output station by a sheet processing device.

There are sheet processing devices, called finishers, that process sheets of specific sizes, e.g. the formats DIN A4 and DIN A5, and also carry out specific processes on the sheets, e.g. center and Z-folds, but that do not have any equipment to punch, bind, staple, etc. the stacks of sheets that are output. Further processing procedures of this type must be carried out on other devices. This makes it necessary to take the loose stack of sheets placed at the output station of the sheet processing device and manually transport it to a further processing device. This involves the danger that the sheets in a sheet stack that are placed so that the edges match will slip around and that individual, or even several, sheets of the stack of sheets that has been placed will become disordered and will have to be aligned again before further processing. This procedure takes a lot of time and is not cost-effective.

SUMMARY OF THE INVENTION

According to an aspect of the invention, an apparatus and method are provided for handling stacks of sheets. According to a preferred embodiment, transport of loose sheets is allowed without disturbing the stack of sheets.

Further characteristics and advantages can be found in the description of an embodiment of the invention and the other subclaims. The drawings show:

DETAILED DESCRIPTION

Figure 1:
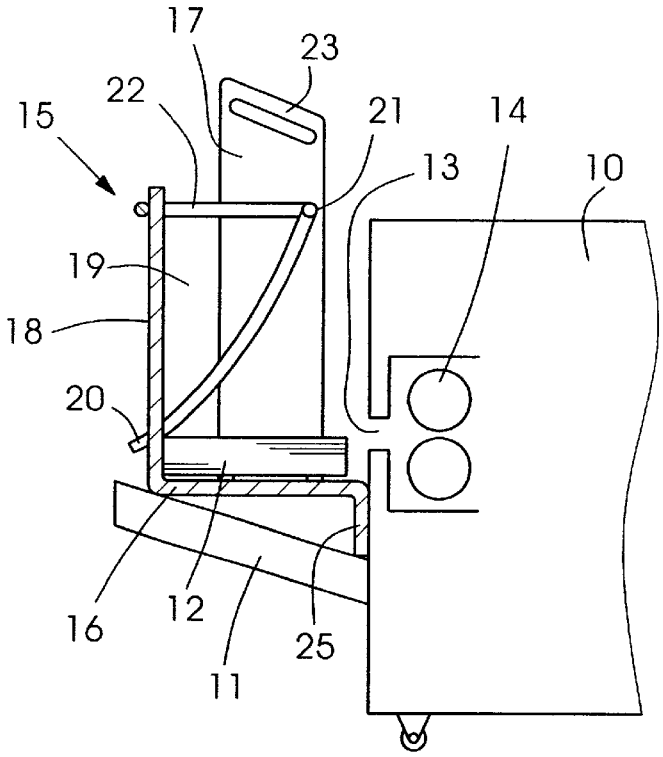
FIG. 1 presents a container according to an aspect of the invention that is placed on the slanted output station of a sheet processing device, in cross section.
Figure 3:
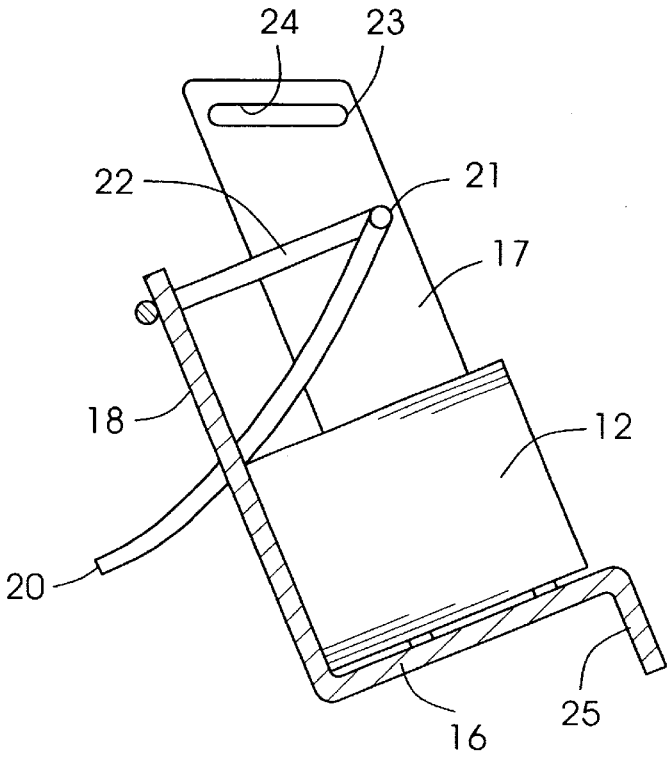
FIG. 3 The container according to FIG. 2 in its freely hanging transport position when lifted off the output station, in cross section.
Figure 2:
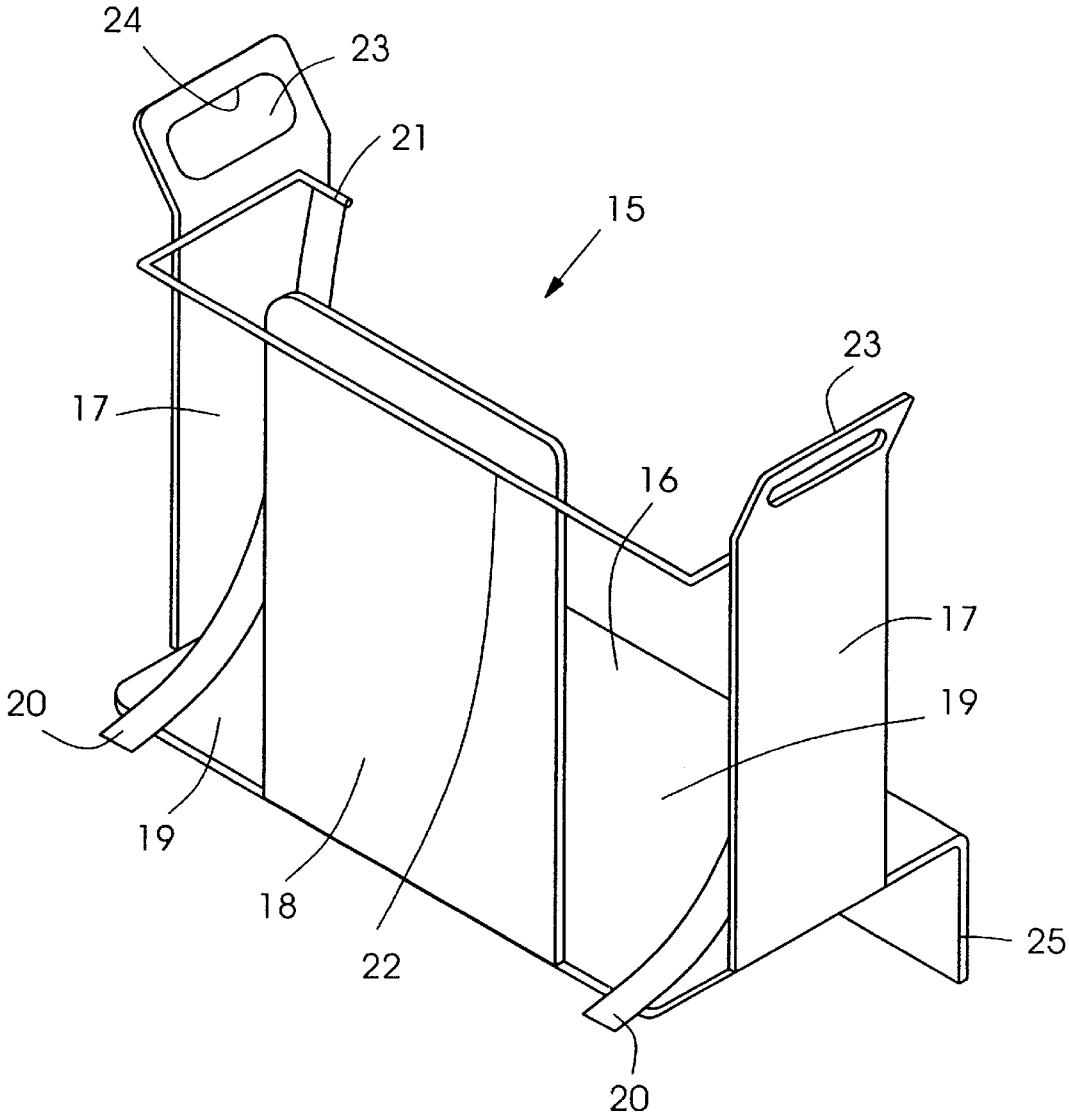
FIG. 2 The container according to FIG. 1 in graphical representation.

Various aspects of the invention are presented in FIGS. 1–3, which are not drawn to scale, and wherein like components are numbered alike. Referring now to FIG. 1, a sheet processing device 10, for example a finisher, has a slanted output station 11 that can be adjusted in height compared to an output slot 13, depending on the height of the stack of sheets 12 placed on it. The sheets 12 may be edge aligned. The output station 10 can be adjusted laterally in order to be able to place complete stacks of sheets 12 at an offset to each other so as to delimit them. These movements of the output station are generated by electrical drives that are not shown which drive the output rollers 14 according to methods and apparatus known in the art.

Certain sheet processing devices combine individual printed sheets into ordered stacks of sheets, and then place them in stacks at an output station prior to final processing. The final processing, for example punching, stapling, binding, etc., may be carried out on a different processing device. The stored stacks of sheets may be manually transported to the different processing device, but the stacks of sheets may become disordered during transport.

According to an aspect of the invention, the sheets are kept ordered by a portable container 15 that can be placed at the output station 10. The container 15 comprises a stacking floor 16 and two side walls 17 that are upright and opposite from each other and an impact wall 18 between the side walls 17 and positionable downstream from the output, for example, opposite the open side of container 15. The stack of sheets 12 rests upon the stacking floor 16.

As can be seen in FIG. 2, an opening 19 may be provided that extends down to the stacking floor 16 between the impact wall 18 and at least one of the two side walls 17. The opening 19 serves as a pass-through for a hold-down device 20, each of which may be linked to a projection 21 attached to the container 15, or other suitable structure. The projection 21 may be part of a support 22, attached to the container 15. The projection 21 may be an angled end of the support 22 that extends into the inside of the container 15. Two or more such openings 19 and hold-down devices 20 may be provided.

The support 22 may connected rigidly to the side walls 17 and to the impact plate 18 and stabilizes same. The support may be a U-shaped strap that is essentially horizontal when the container 15 rests on the output station 11.

The hold-down devices 20 may be a flexible plastic material and lie on the top sheet at both ends of a stack of sheets in order to prevent arching of the top sheets and thus avoid difficulty in placing the next stack of sheets. The hold-down device 20 may generate a predetermined contact pressure on the top sheets in a stack of sheets within the container 15.

The container 15 preferably comprises at least one carrying handle 23 having a handle surface 24 that runs at an acute angle to the stacking floor 16, or other suitable structure for lifting the container 15. The container 15 may be lifted by the handle 23 off or away from the output station 11 wtih the container 15 in a tipped position such that the stack of sheets 12 is supported upon impact wall 18 and safely stays in position during transport, as best shown in FIG. 3. The container 15 may be tipped to a position wherein the stacking floor 16 is not horizontal. At least one of the side walls 16 may have a handle 23. In the embodiment of FIG. 2, the free upper ends of the side-walls 17 form a pair of carrying handles 23.

As shown in FIG. 1, output station 11 may be arranged in a slanted position in sheet processing device 10. For this reason, container 15 has a support foot 25 at the processing device end of its stacking floor 16, which is designed as a right angle in the embodiment shown, and is positioned to rest on the output station 11.

One side of the support foot 25 may contact the output station 11 and the opposing side may contact the front wall of sheet processing device 10. The vertical length of the support foot 25 may be dimensioned in such a way that when the container 15 is placed on the output station 11, the stacking floor 16 of the container 15 is horizontal. The support foot 25 may extend across the width of said stacking floor 16 at an angle thereto A design such as this of support foot 25 and its contact on the front wall of the sheet processing device 10 also secures the position of container 15 on the output station 11.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof.

What is claimed is:

1. An apparatus for handling one or more stacks of sheets that are output to an output station having a slanted surface by a sheet processing device, comprising:

a portable container that can be placed at the output station on the slanted surface and having a stacking floor, a support foot positioned to render said stacking floor horizontal when said portable container is placed on the slanted surface, two upright side walls that are opposite each other, and an upright impact wall between said two upright side walls and positionable downstream from the output, wherein sheets received from the sheet processing device rest upon said stacking floor contained by said two upright side walls and said impact wall.

2. The apparatus of claim 1, wherein an opening is provided between said impact wall and each side wall that extends to the stacking floor.

3. The apparatus of claim 1, further comprising a support fastened rigidly to both side walls and said impact wall.

4. The apparatus of claim 1, wherein said side walls comprise a carrying handle having a handle surface that runs at an acute angle relative to said stacking floor.

5. An apparatus for handling one or more stacks of sheets that are output to an output station by a sheet processing device, comprising:

a portable container that can be placed at the output station and having a stacking floor, two upright side walls that are opposite each other, and an upright impact wall between said two upright side walls and positionable downstream from the output, wherein sheets received from the sheet processing device rest upon said stacking floor contained by said two upright side walls and said impact wall;

further comprising a support fastened rigidly to both side walls and said impact wall, wherein said support is a U-shaped strap.

6. An apparatus for handling one or more stacks of sheets that are output to an output station by a sheet processing device, comprising:

a portable container that can be placed at the output station and having a stacking floor, two upright side walls that are opposite each other, and an upright impact wall between said two upright side walls and positionable downstream from the output, wherein sheets received from the sheet processing device rest upon said stacking floor contained by said two upright side walls and said impact wall wherein said portable container rests on a slanted surface of the output station, and said stacking floor has a support foot positioned to rest on the output station with said stacking floor horizontal.

7. The apparatus of claim 6, wherein said support foot extends across the width of said stacking floor at an angle thereto.

8. An apparatus for handling one or more stacks of sheets that are output to an output station by a sheet processing device, comprising:

a portable container that can be placed at the output station and having a stacking floor, two upright side walls that are opposite each other, and an upright impact wall between said two upright side walls and positionable downstream from the output, wherein sheets received from the sheet processing device rest upon said stacking floor contained by said two upright side walls and said impact wall, and a hold-down mounted to hold top sheets of a stack of sheets within said container.

9. The apparatus of claim 8, wherein the hold-down device consists of a flexible plastic material.

10. An apparatus for handling one or more stacks of sheets that are output to an output station by a sheet processing device, comprising:

a portable container that can be placed at the output station and having a stacking floor, two upright side walls that are opposite each other, an upright impact wall between said two upright side walls and positionable downstream from the output, at least one handle having a handle surface that runs at an acute angle relative to said stacking floor, and a hold-down mounted to hold top sheets of the stack of sheets wherein sheets received from the sheet processing device rest upon said stacking floor contained by said two upright side walls and said impact wall.

11. A method of handling stacks of sheets, comprising:

receiving sheets into a portable container resting on a slanted surface of an output station, said portable container having a horizontal stacking floor, two upright side walls that are opposite each other, and an upright impact wall between said two upright side walls, said sheets resting in a stack on said stacking floor; and, transporting said portable container.

12. The method of claim 11, further comprising lifting said portable container by a handle having a handle surface that runs at an acute angle relative to said stacking floor.

13. The method of claim 11, further comprising positioning a hold-down upon said stack.

14. The method of claim 11, further comprising offsetting said sheets relative to each other.

15. The method of claim 11, further comprising positioning a flexible plastic hold-down upon said stack.

16. The method of claim 11, further comprising positioning a hold-down upon opposing ends of a top sheet of said stack.

17. The method of claim 11, further comprising positioning a hold-down upon said stack with a predetermined contact pressure on a top sheet of said stack.

18. The method of claim 11, further comprising lifting said portable container into a tipped position such that said stack is supported upon said impact wall.

* * * * *